US007334563B2

(12) United States Patent
Mifuji et al.

(10) Patent No.: US 7,334,563 B2
(45) Date of Patent: Feb. 26, 2008

(54) FUEL INJECTOR AND IN-CYLINDER DIRECT-INJECTION GASOLINE ENGINE

(75) Inventors: Masanori Mifuji, Hitachinaka (JP); Tohru Ishikawa, Kitaibaraki (JP); Atsushi Sekine, Hitachinaka (JP); Yoshio Okamoto, Higashiibaraki (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 11/342,870

(22) Filed: Jan. 31, 2006

(65) Prior Publication Data

US 2006/0191511 A1 Aug. 31, 2006

(30) Foreign Application Priority Data

Feb. 1, 2005 (JP) ..... 2005-025307

(51) Int. Cl.
*F02B 3/02* (2006.01)
*F02M 61/18* (2006.01)

(52) U.S. Cl. ..... 123/299; 123/305; 239/504; 239/533.12

(58) Field of Classification Search ..... 123/295, 123/299, 305; 239/463, 494, 496, 497, 533.12, 239/504

See application file for complete search history.

(56) References Cited

U.S. PATENT DOCUMENTS 4,958,604 A * 9/1990 Hashimoto ..... 123/305
5,058,549 A * 10/1991 Hashimoto et al. .... 239/533.12
5,244,154 A * 9/1993 Buchholz et al. ..... 239/533.12
5,636,796 A * 6/1997 Oguma ..... 239/533.12
6,206,304 B1 * 3/2001 Koseki et al. ..... 239/533.12
6,405,935 B2 * 6/2002 Dantes et al. ..... 239/496
6,783,085 B2 * 8/2004 Xu ..... 239/463
6,817,545 B2 * 11/2004 Xu ..... 239/533.12
6,848,635 B2 * 2/2005 Xu ..... 239/533.12
7,082,922 B2 * 8/2006 Abe et al. ..... 123/305
7,168,637 B2 * 1/2007 Goenka et al. ..... 239/533.12

FOREIGN PATENT DOCUMENTS

JP 2003-314411 11/2003
JP 2003-534485 11/2003
JP 2004-028078 1/2004

* cited by examiner

*Primary Examiner*—T. M Argenbright
(74) *Attorney, Agent, or Firm*—Crowell & Moring LLP

(57) ABSTRACT

A fuel injector has a plunger for opening/closing a fuel path to control the amount of fuel to be injected; a seat portion for the plunger; and a plurality of nozzle holes for injecting fuel passed through between the plunger and the seat portion, A nozzle plate is provided with the seat portion, and a taper-fuel inlet hole has a diameter that gradually reduces from the seat toward its outlet, An orifice plate is arranged downstream from the taper-fuel inlet hole, and is provided with a concave portion opposite to the nozzle plate, with a plurality of nozzle holes being formed concentrically at a bottom of the concave portion. Each nozzle hole has an inclined angle in the direction of the plate thickness within the concave area.

12 Claims, 11 Drawing Sheets

FUEL INJECTOR AND IN-CYLINDER DIRECT-INJECTION GASOLINE ENGINE

CLAIM OF PRIORITTY

The present application claims priority from Japanese application Ser. No. 2005-025307, filed on Feb. 1, 2005, the content of which is hereby incorporated by reference into this application.

BACKGROUND OF THE INVENTION

The present invention relates to a fuel injector used in an internal-combustion engine.

With regard to fuel injectors used in internal-combustion engines, a conventional method of injecting fuel from a plurality of nozzle holes is proposed to enhance injection pattern control and atomization (as described in, for example, Patent Document 1: Japanese Application Patent Laid-open Publication No. 2003-314411 (pages 5 and 6, FIG. 1). The fuel injection nozzle described in Patent Document 1 has a nozzle front chamber, which is flat overall. So fuel flows horizontally from the outer periphery side toward the inner periphery side and isotropically collides immediately above the nozzle holes, thereby encouraging dispersion at the time of injection to enhance atomization.

A means for generating a flat spray pattern is also proposed for a fuel injector used in an internal-combustion engine (as described in, for example, Patent Document 2: Japanese Application Patent Laid-open Publication No. 2004-28078 (pages 6 and 7, FIG. 1)). The fuel injector described in Patent Document 2 has a first nozzle hole section that forms flat fuel sprays in a particular direction, and a second nozzle hole section that forms another fuel spray pattern deflected in one of the directions orthogonal to the fuel sprays formed by the first nozzle hole section. The fuel sprays is formed for injection in the cylinder that is suitable for stratified combustion and homogeneous combustion.

Another means provided for a fuel injector used in an internal-combustion engines produces a spray pattern by which a suitable air-fuel mixture can be formed around the ignition plug (as described in, for example, Patent Document 3: Japanese Application Patent Laid-open Publication No. 2003-534485 (pages 7 and 8, FIG. 1)). The fuel injector described in Patent Document 3 has at least one spacing between spray flows in an area apart from the ignition plug so as to form fuel sprays for in-cylinder injection that are suitable for stratified combustion and homogeneous combustion.

SUMMARY OF THE INVENTION

To atomize fuel through a plurality of nozzle holes, the fuel flow rate at the time of injection needs to be kept high in the nozzle holes.

In the prior arts described in Patent Documents 1 to 3, the entire nozzle front chamber is flat so that the fuel flow from the outer periphery toward the inner periphery and subsequent collisions immediately above the nozzle holes allow dispersion to be caused easily to enhance atomization; the structure is not necessarily preferable to further increase the fuel flow rate in the nozzle holes (to, for example, further increase the pressure), and better atomization performance may not be obtained.

Recently, in-cylinder direct-injection gasoline engines (referred to below as in-cylinder injection engines) aimed at achieving high output with low fuel consumption are put in practical use. These in-cylinder injection engines require a fuel spray pattern suitably formed according to the combustion method, combustion chamber shape, combustion chamber size, and other parameters.

As for the technologies disclosed in Patent Documents 2 and 3, exemplary methods of forming spray patterns critically related to the forming of an air-fuel mixture are described; fuel sprays suitable for both stratified combustion and homogeneous combustion can be injected in the cylinder, so fuel pattern collisions with the piston and intake valve can be suppressed (Patent Document 2); an air-fuel mixture that enables stable combustion without contaminating the ignition plug due to smoldering is formed in an ignition plug area so as to achieve stratified combustion operation (Patent Document 3).

The in-cylinder injection engine takes only a short time from when fuel is sprayed until an ignition occurs, so fuel must be evaporated in a short time. This requires fuel to be atomized in order to perform fast evaporation on a larger surface area for the comparable amount of fuel. Accordingly, the spray pattern and fuel atomization affect fuel economy and the amount of unburned fuel (referred to below as HC) and nitrogen oxides (referred to below as NOx) in the exhaust gas from the engine.

For example, fuel may adhere to the inner wall of the cylinder and piston crown surface depending on some spray pattern or fuel drip coarseness, and adhering fuel that remains unevaporated is exhausted without being burned, which decreases the fuel economy and increases the amount of HC. In operation in which injection is performed in an intake process, interference may occur between the intake valve in the open state and the spray. Part of the fuel adhering to the intake valve does not flow into the combustion chamber, which may impede accurate control for the air-to-fuel ratio in the combustion chamber. If the air-to-fuel ratio control is not performed accurately as described above, a too large amount of injection to be supplied to the fuel injector is commanded by feedback control based on an oxygen concentration sensor or the like provided in the exhaust system. Consequently, the amount of HC exhausted may be increased.

When the fuel injector is disposed at the center of the combustion chamber, the positional relation between the spray and ignition plug as well as fuel atomization are important. If liquid fuel or coarse fuel drips directly collide against the ignition plug, the ignition plug may smolder.

To increase the fuel economy and exhaustion performance of an in-cylinder injection engine, it is important to improve the atomization property and perform optimum spray pattern control.

It is an object of the present invention to improve atomization performance of a fuel injector and to provide a fuel injector that enables adjustment of a spray pattern to obtain sprays preferable for an engine.

A fuel injector of the present invention is comprised of:

a plunger for opening/closing a fuel path to control the amount of fuel to be injected; a seat portion for the plunger;

a plurality of nozzle holes for injecting fuel passed through between the plunger and the seat portion, and the fuel injector further is comprising of:

a nozzle plate provided with the seat portion, and a taper-fuel inlet hole whose diameter is gradually reduced from the seat toward its outlet; and a orifice plate arranged downstream from the taper-fuel inlet hole, and provided with a concave portion opposite to the nozzle plate, and a plurality of nozzle holes being formed concentrically at a bottom of the concave, wherein the plurality of nozzle holes are formed so that each nozzle hole has an inclined angle in the direction of the plate thickness within the concave area.

Specifically, a fuel inlet hole having a tapered diameter is formed in the fuel path extending from the seat portion of the fuel injector to the plurality of nozzle holes, an orifice plate in a concave shape is provided downstream of the fuel inlet hole, and a plurality of nozzle holes are formed concentrically at the concave bottom of the orifice plate toward the outside. After the fuel flow toward the nozzle holes collides against the central part of the concave bottom, the fuel flows radially and reaches the respective nozzle holes. Since the radial paths are tapered, the fuel flow rates at the outer periphery do not decrease significantly. Accordingly, high-speed fuel flows are achieved, enhancing atomization. The nozzle holes formed concentrically make the fuel flow rates homogeneous, resulting in superior atomization in each hole. Since the orifice plate has a concave shape which enables the mechanical strength to be increased, the injection fuel is highly pressurized. This further increases the fuel flow rate, thereby further enhancing atomization.

Each of the plurality of nozzle holes formed concentrically at the concave bottom of the orifice plate toward the outside has a desired inclined angle inside the concave bottom surface and in the direction of the plate thickness, which enables adjustment of a spray pattern. Particularly, interaction of the spray flows from the individual nozzle holes can be used; when, for example, the nozzle holes are formed close to one another, the surrounding air is suppressed from being introduced and the distance by which the spray travels can be controlled. Conversely, when the nozzle holes are spaced apart from one another, the sprays can be oriented in desired directions by avoiding their interference so as to create substantially flat sprays. This enables injection even in a flat combustion chamber.

A fuel injector according to the present invention forms sprays preferable for an engine by improving atomization performance of the fuel injector and enabling adjustment of a spray pattern.

DETAILED DESCRIPTION OF THE INVENTION

Embodiment 1

Embodiments of a fuel injector according to the present invention will be now described.

Figure 1:
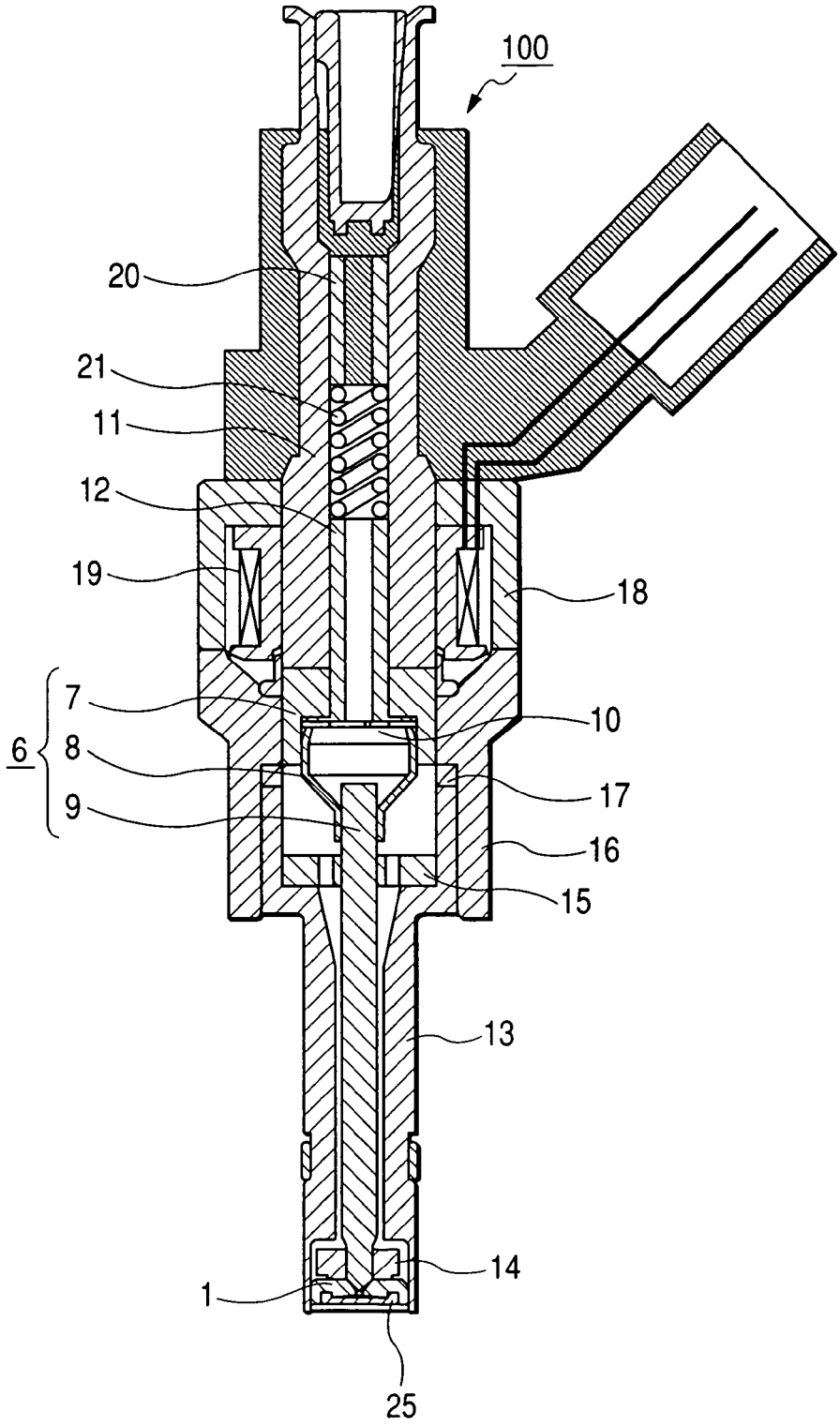
FIG. 1 is a cross-sectional view of the structure of a fuel injector according to the first embodiment of the present invention.
Figure 2:
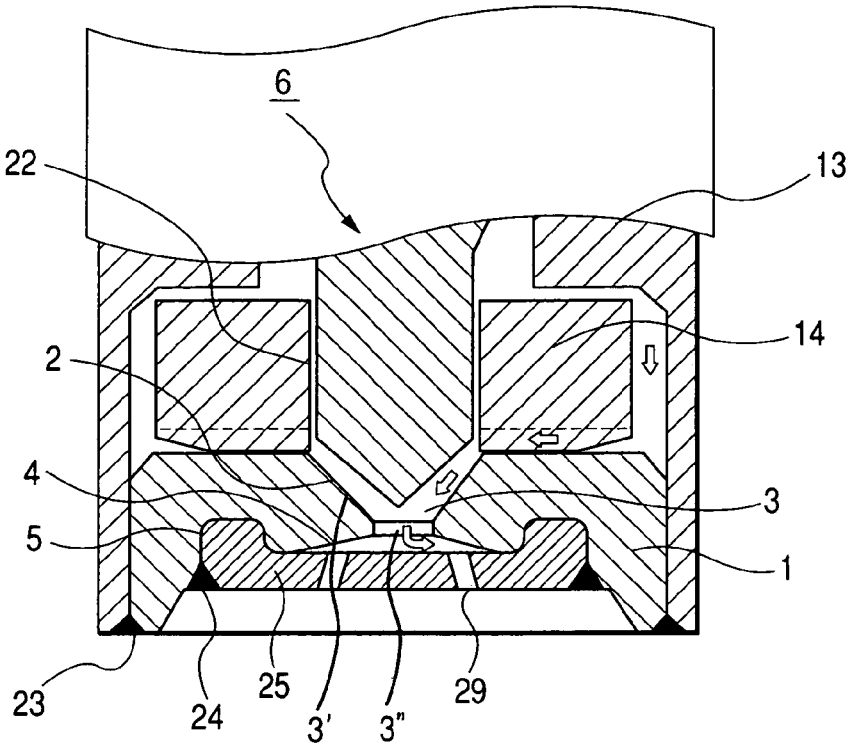
FIG. 2 is an enlarged cross-sectional view of part near the nozzle hole of the fuel injector shown in FIG. 1.

FIGS. 1 and 2 show a first embodiment of a fuel injector 100. FIG. 1 is a cross-sectional view of the entire structure of the fuel injector 100. FIG. 2 is a local-sectional view of the fuel injector 100 shown in FIG. 1.

In FIG. 1, a body of the fuel injector 100 is mainly comprised of a nozzle body 13, a nozzle housing 16 for holding the nozzle body 13, a yoke 18 being arranged around an electromagnet 19, and a stationary core 11 etc. A tip side (a lower end portion in FIG. 1) of the nozzle body 13 is provided with a fuel path member 14 and a nozzle plate 1. The fuel path member is shaped like a ring, an inner surface 22 thereof serves as guide for plunger (valve plug) 6-movement. The nozzle plate 1 is provided with a nozzle hole which serves as a nozzle inlet hole 3 in the center thereof. An outer periphery of the nozzle plate 1 is fixed to the nozzle body 13 by welding 23 or another fastening means.

In the nozzle body 13, a guide plate 15 is fixed inside the one end side (upper side in FIG. 1) opposite to the nozzle plate 1. The plunger 6, which is movable in longitudinal direction of the injector, is incorporated into the nozzle body so as to be slidably guided through a center hole of the guide plate 15 and the inner surface 22 of the fuel path member 14. The plunger 6 is formed by combining a cylindrical movable core 7, a joint member 8, and valve rod 9 by welding or another fastening means. The movable core 7 and the valve rod are jointed to each other through the joint member 8.

A ring-shaped damper plate 10 is fixed inside the movable core 7, and its outer periphery edge is supported longitudinally by the top surface of the junction member 8.

A damper motion member 12 is slidably inserted longitudinally across an inner radius of the stationary core 11 and an inner radius of the movable core 7. One end of the damper motion member 12 is positioned so that it is brought into contact with an inner side top surface of the damper plate 10. The damper plate 10 functions as a leaf spring because its outer side potion is supported by the top surface of the joint member 8 and its inner side portion is capable of warping in the axial direction. For example, the damper plate 10 is in a ring-shape, and plural elastic pieces (not shown) formed inside the ring-shape plate protrude inwardly.

The nozzle body 13 is fixed in the nozzle housing 16. A ring 17 for adjusting the stroke of the plunger 6 is interposed between the upper end of the nozzle body 13 and a ring receiving portion of the nozzle housing 16.

A spring adjustment pin 20 is fixed inside the stationary core 11, and a spring 21 is interposed in a compressed state between the spring adjustment pin 20 and the damper motion member 12. One end of the spring 21, which is the spring pin 20-side, acts as a fixed end, and the other end thereof acts as a free end. The spring force of the spring 21 is transferred to the plunger 6 through the damper motion member 12 and damper plate 10. Accordingly, the plunger 6 is pressed against a seat 4 of the nozzle plate 1. In this state, the fuel path is closed, so fuel remains in the fuel injector 100 and the fuel is not injected from a plurality of nozzle holes 29. These nozzle holes 29 are arranged downstream from the fuel inlet hole 3.

The nozzle housing 16, movable core 7, stationary core 11, and yoke 18 form a magnetic circuit that surrounds the electromagnet 19 by one turn.

When an injection pulse as an electric signal is issued, a current flows into the electromagnet 19 and the movable core 7 is attracted toward the stationary core 11 by an electromagnetic force. The plunger 6 then moves up to a position where its upper end comes into contact with the lower end of the stationary core 11. In this state, the plunger 6 is detached from the valve seat 4, and then a circular gap is formed between the plunger 6 and seat 2. So the fuel path is opened, and fuel is injected out from the plurality of fuel nozzle holes 29.

When the injection pulse is turned off, the current to the electromagnet 19 is discontinued and the electromagnetic force is lost; the plunger 6 is returned to the closed state by the spring force of the spring 21, terminating the fuel injection.

An operation of the fuel injector 100 is to control the amount of fuel to be supplied by switching the position of the plunger 6 between the open state and closed state according to the injection pulse, as described above. Another operation of the fuel injector 100 is to form fuel sprays with small fuel particle sizes, that is, superiorly atomized fuel sprays by injecting the fuel from the plurality of nozzle holes 29.

FIG. 2 is an enlarged cross-sectional view of the lower part of the nozzle body 13, which includes the nozzle plate 1 and orifice plate 25 shown in FIG. 1, the nozzle plate and orifice plate being the main elements of the present invention. FIG. 2 shows the state where the plunger 6 is lifted upward, that is, the valve open state.

At the tip of the nozzle body 13, the cylindrical fuel path member 14, nozzle plate 1, and orifice place 25 are inserted in that order. The outer periphery of the nozzle plate 1 is fixed by, for example, welding 23.

The nozzle plate 1 has the seat 2, which is a contact portion where the tip of the plunger 6 comes into contact with at the time of valve closing, and the fuel inlet hole 3. The fuel inlet hole 3 is configured by a taper upstream portion 3', a middle portion 3" and an extended downstream portion 4. The diameter of the taper upstream portion 3' is gradually reduced from the seat 2 up to the middle portion 3". The diameter of the extended downstream portion 4 is extended in a shallow conical-shape from the middle portion 3" toward downstream. On the downstream side face of the nozzle plate 1, a circular groove 5 is formed around the extended downstream portion 4. A circular protrusion of the orifice plate 25 is fitted into the concave groove 5, and the outer periphery of the orifice plate 25 is fixed to the nozzle plate 1 by, for example, welding 24.

Fuel in nozzle body 13 flows from the upstream of the fuel path member 14 to the fuel inlet hole 3 in the nozzle plate 1 through the outer path of the fuel path member 14 and the bottom path of the member 14. Fuel further proceeds to the plural nozzle holes 29 formed downstream of the fuel inlet hole 3, as indicated by arrows. Then, the fuel is injected out being controlled in a desired direction.

The thickness of the orifice plate 25 and the nozzle holes therein are machined by cutting or stamping. When the outlet portion of the nozzle hole is polished after the machining, the outlet portion of the nozzle hole can have a shape edge.

Figure 3:
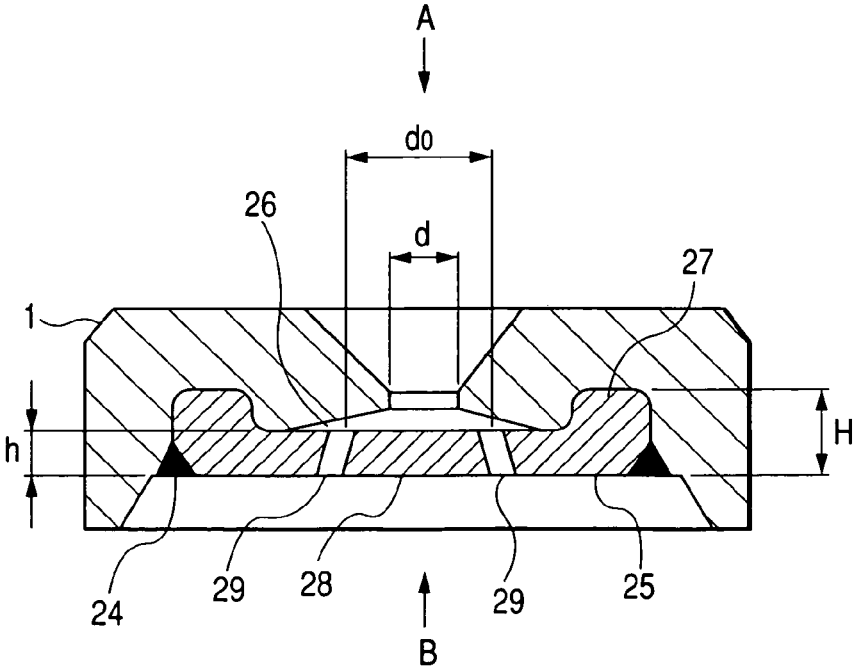
FIG. 3 is a cross-sectional view for illustrating the effect of the orifice plate of the fuel injector shown in FIG. 2.

FIG. 3 shows an assembly in which the nozzle plate 1 and orifice plate 25 are combined. The orifice plate 25 is formed in a concave shape. The circular protrusion portion 27 is fitted into the concave groove 5 on the nozzle plate 1 as described previously. The plurality of nozzle holes 29 are formed at the concave bottom 26. The orifice plate 25 is concaved because the concave shape significantly increases the mechanical strength and is preferable for applying a high pressure to the fuel to be injected. In this shape, in particular, the height H of the fitted portion of the orifice plate 25 is preferably 0.4 mm or more, which can suppress the effect of welding distortion on the nozzle holes 29. The thickness h of the thin portion of the orifice plate 25 is preferably 0.25 mm or more, which is advantageous with respect to resistance to pressure, effect of welding distortion, and easiness of hole machining.

Figure 11:
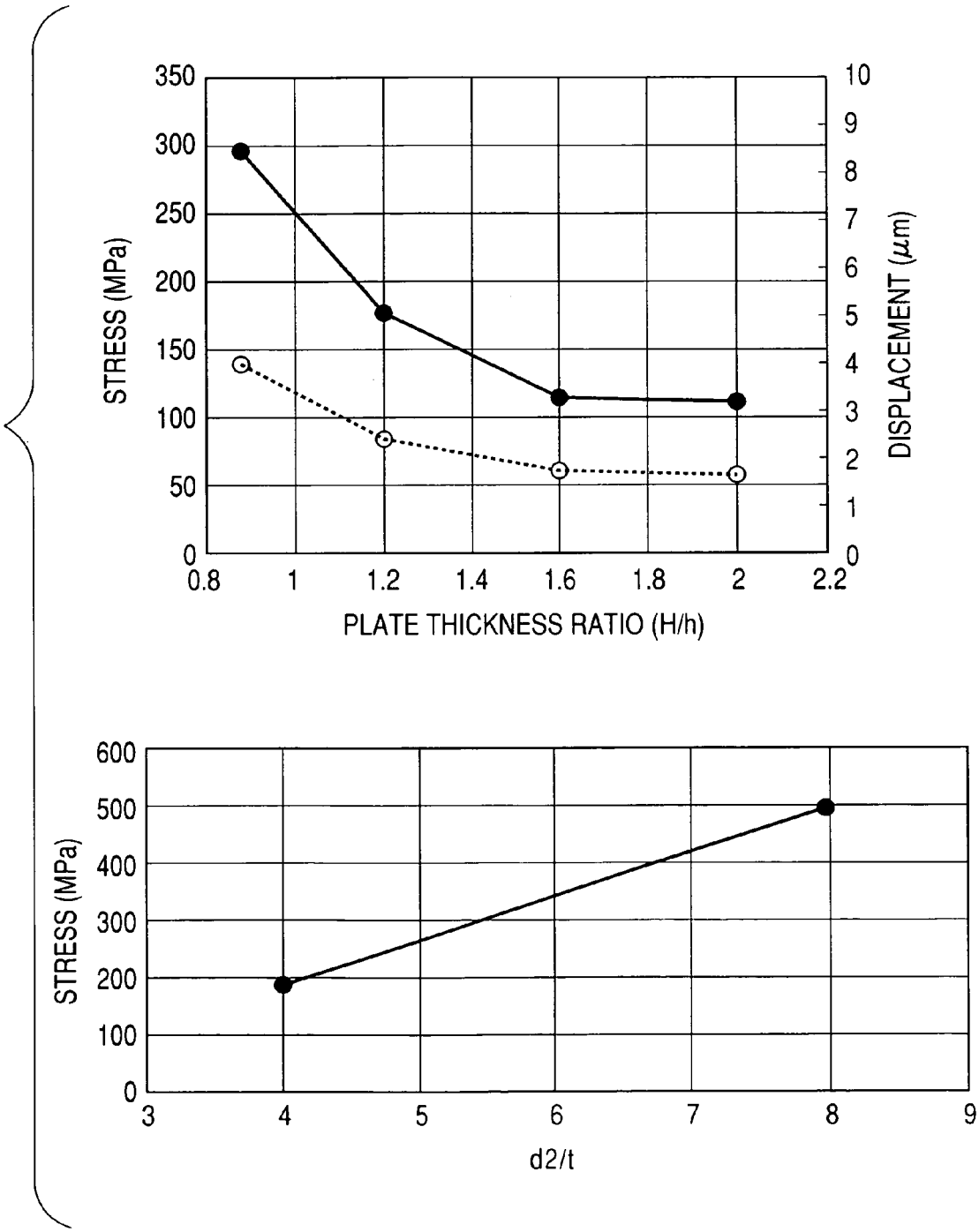
FIG. 11 shows a graph that represents the relation between the plate thickness ratio and stress and the relation between the plate thickness ratio and displacement, and also shows another graph that represents the relation between d2/t and the stress.

FIG. 11 is a graph representing a plate thickness ratio H/h on the horizontal axis, and stress and displacement on the vertical axes.

In FIG. 11, each stress is indicated with the black dot mark, and each displacement is indicated with the white dot marl. FIG. 11 indicates that as the value of H/h increases, the stress and displacement decrease; when H/h is 1.6 or more, resistance to pressure is no problem. However, too large H/h values are problematic because, for example, the machining of holes becomes difficult or a large amount of fuel remains downstream of the seat.

Assuming that the pitch between the nozzle holes, which is formed concentrically in the orifice plate 25, is d2 and the thickness of a concave formed-plate for the fuel path is t, the following relation is obtained:

$$4<d2/t<8$$

As d2/t approaches 4, stress decreases and resistance to pressure increases, but too small d2/t makes it difficult to machine holes.

The amount of fuel to be injected can be checked by using the orifice plate 25 alone under low pressure or in an assembled state in which the nozzle plate 1 is combined to the orifice plate 25. It is important to reduce failure rates in subsequent processes.

Figure 4A:
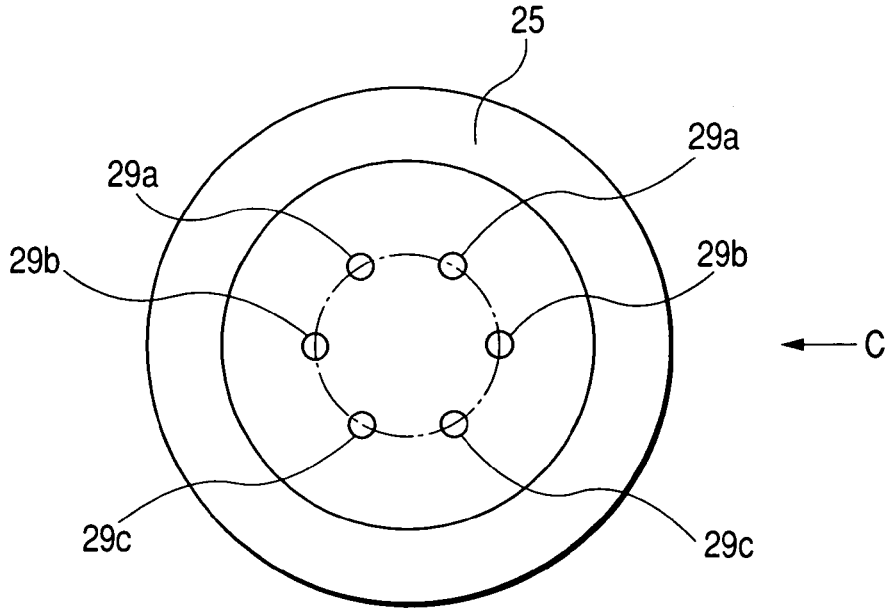
FIGS. 4(*a*) and 4(*b*) indicates the positions of the holes formed in the orifice plate of the fuel injector shown in FIG. 2.
Figure 4B:
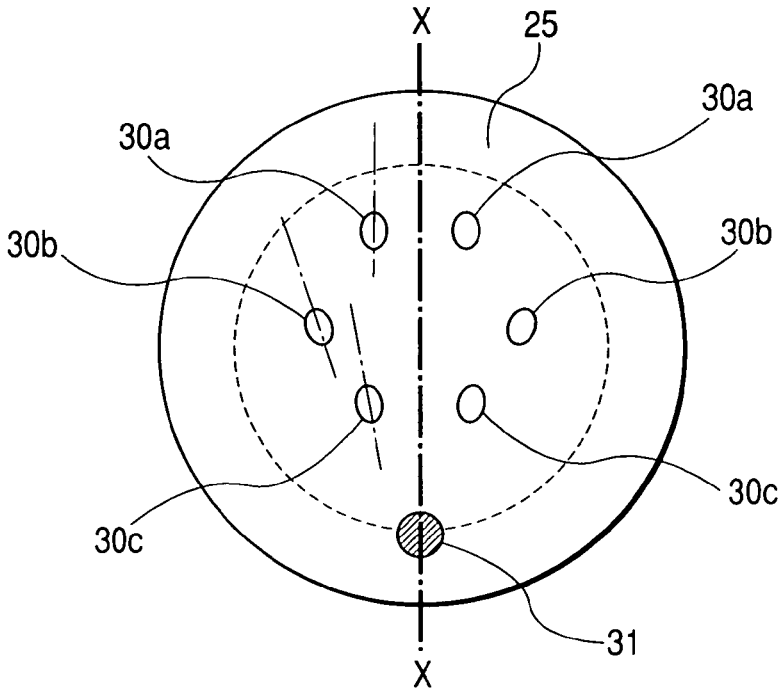

The nozzle holes 29 are concentrically formed as shown in FIG. 4 (*a*).

This layout of the nozzle holes enables fuel to be equally supplied to the holes which thereby reduces variations in flow rate and assures accurate injection. As for the number of nozzle holes 29 to be preset, various investigations were made in terms of machining and injection performance, and 6 holes were selected as the optimum design value. If, for example, the number of holes is reduced, each hole diameter has to be increased to assure the same amount of flow, so atomization performance is deteriorated.

Conversely, if the number of holes is too increased, each hole-diameter can be reduced to suppress the amount of flow to the comparable value. Consequently, in this case, holes have to be formed closely to one another due to geometrical size restrictions. This causes atomized sprays to mutually interfere or recombine. The resulting sprays are not preferable in terms of both atomization and the shape. The geometrical size restrictions include, for example, the necessity to determine a size required to resist to the pressure and to minimize the spatial volume not required for injection control.

Another surface 28 on which the nozzle holes 29 are open has a surface roughness of 1 μm or less. This enables the opening end of each nozzle hole 29 to have a sharp edge. This structure is advantageous in that, for example, extra drips are not scatter, the injected fuel is directed reliably to a predetermined direction, and atomization performance is improved by a better anti-dripping property of fuel.

In addition, the nozzle holes 29 are open at desired angels on the other surface 28 as shown in FIG. 4 (*b*).

The holes 30*a*, 30*b*, and 30*c* in FIG. 4 (*b*) correspond to the holes 29 having the same suffix, respectively. These holes are open at different desired angles also in the plate thickness direction (not shown).

For example, the hole 30*a* is inclined in the 0-degree direction with respect to the X axis in FIG. 4 (*b*) and inclined by about 46 degrees in the plate thickness direction. The hole 30*b* is inclined by about 26 degrees and inclined by about 20 degrees in the plate thickness direction. The hole 30*c* is inclined by about 13 degrees and inclined about 26 degrees in the plate thickness direction.

Reference numeral 31 indicates a mark formed by, for example, marking or punching after the holes have been made. The mark clearly indicates the position at which to attach the orifice plate and the direction in which to direct fuel; the marking is useful when, for example, an engine is mounted.

In view of machinability and mechanical strength as described above, the material of the orifice plate is preferably ferrite-based stainless steel.

Embodiments of injection in a nozzle construction as described above will be described below.

Fuel flows into the fuel inlet hole 3 through the taper upstream portion 3', and collides against the concave bottom 26 of the orifice plate 25. Thereby, after the fuel-collision to the concave bottom, the fuel flows in radial direction. As the extended downstream portion 4 prevents the fuel flow rate from being reduced, the fuel is supplied to the plurality of nozzle holes 29 that are concentrically formed while high-speed (high-pressure) energy is maintained.

As the fuel radially proceeds along the outward wall surface portion of each nozzle hole 29, a fuel spray injected from the nozzle 29 has a C-shaped flow rate distribution in cross section. The fuel spray having the C-shaped flow rate distribution exchanges its energy with the ambient atmosphere more actively than usual contraction flow-sprays. Consequently, fragmentation of fuel spray particles is encouraged and well-atomized sprays are obtained. To form the C-shaped flow rate distribution more reliably, the ratio do/d of the distance do between the centers of nozzle holes to the diameter d of the fuel inlet hole 3 is preferably preset to 2 or more.

Figure 5A:
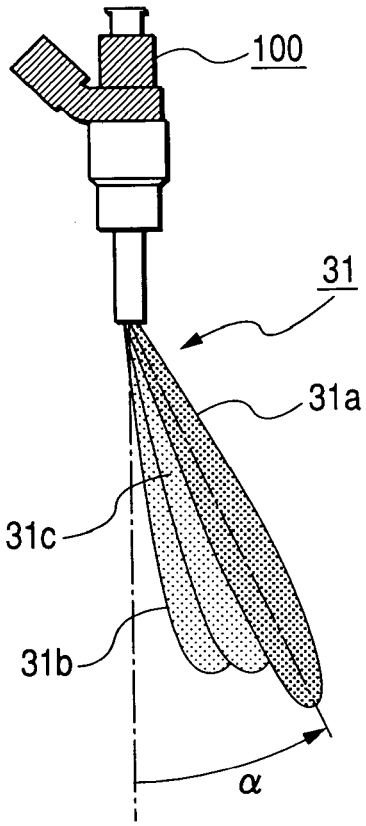
FIGS. 5(*a*)-5(*c*) schematically shows flat sprays obtained by the fuel injector shown in FIG. 2.
Figure 5B:
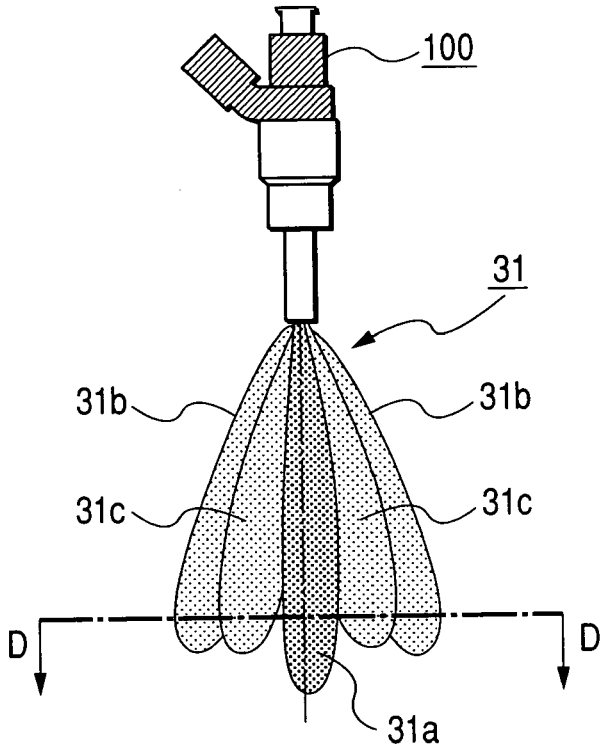
Figure 5C:
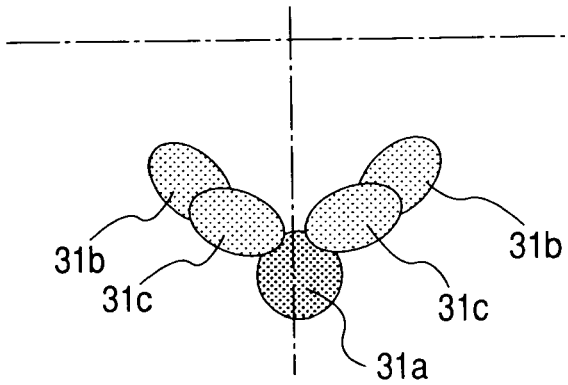

FIGS. 5 (*a*), 5 (*b*), and 5 (*c*) schematically show fuel sprays 31 in three ways, according to a picture of sprays that is obtained by using strobe light or a laser beam to optically take the picture.

FIG. 5 (*a*) schematically shows sprays when the nozzle holes 29 shown in FIG. 4 (*b*) are viewed in the C direction. FIG. 5 (*b*) is schematically shows sprays when the sprays of FIG. 5 (*a*) are viewed from lateral side. FIG. 5 (*c*) is a cross-sectional view showing section D-D in FIG. 5 (*b*).

In FIG. 5 (*a*), the sprays 31 are deflected in the a direction and are approximately V-shaped flat sprays. The sprays 31*a*, 31*b*, and 31*c* in FIG. 5 (*a*) correspond to the holes 30*a*, 30*b*, and 30*c* on the outlet side of the orifice plate 25. The travel distance of the spray 31*a* shown in FIG. 5 (*a*) is long as compared with 31*b* and 31*c*. This is because the two holes 30*a* are formed in parallel and slightly close to each other. The spray densities on the opposite sides become high and entrance of the ambient atmosphere is suppressed. Such a spray form prevents the energy of spray drips from being exchanged with the ambient atmosphere, and maintains the energy of the spray drips (particles). Consequently, the drips travel further.

The sprays 31 in FIG. 5 (*a*) are inclined in the a direction. The inclination angle $\alpha$ is determined depending on the layout for mounting the engine. In this embodiment, the angle is preset so that the sprays are oriented toward the ignition plug.

Figure 12A:
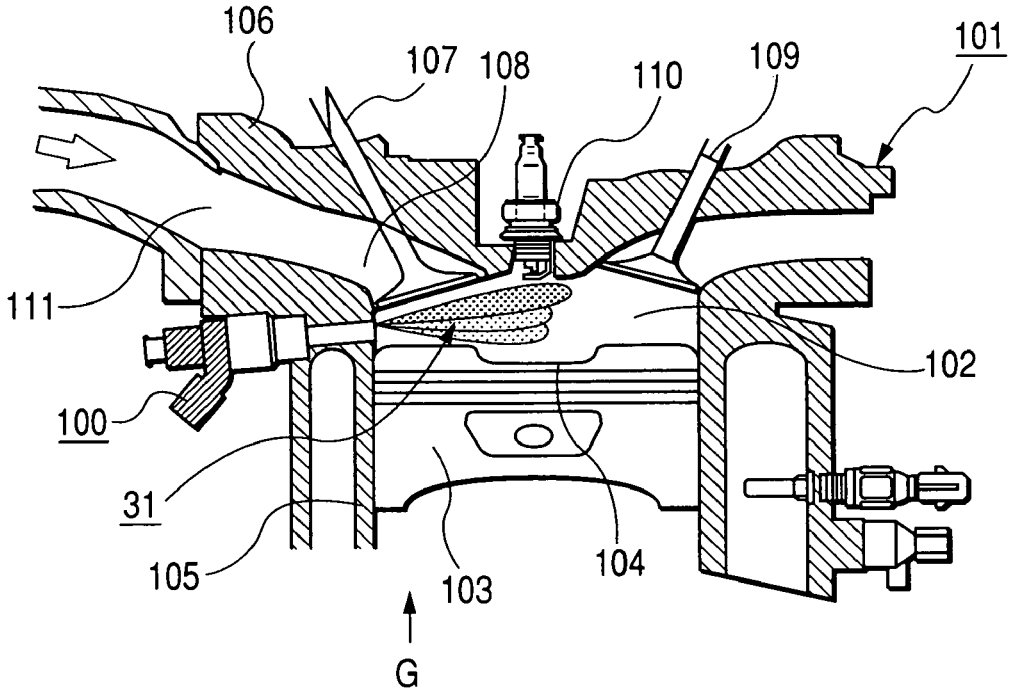
FIGS. 12(*a*) and 12(*b*) schematically shows an example in which the fuel injector, shown in FIG. 1, according to the first embodiment is mounted on an in-cylinder injection internal-combustion engine.
Figure 12B:
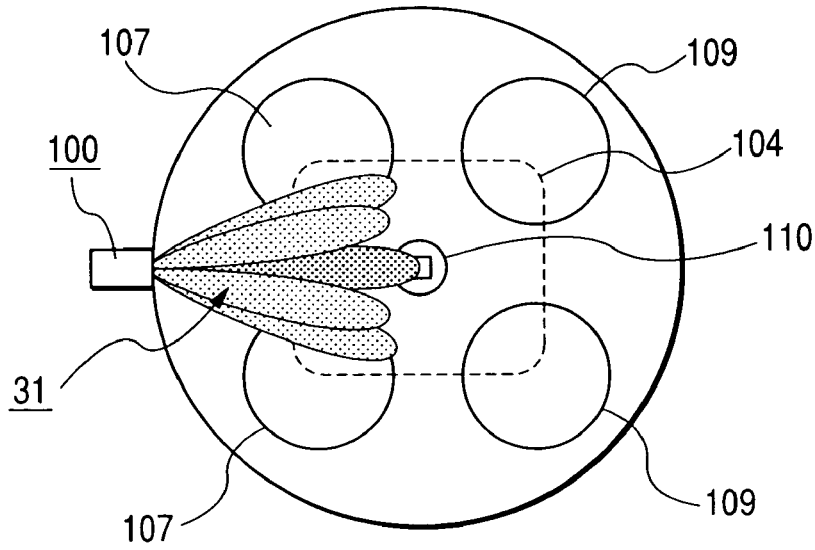

The sprays 31 in FIG. 5 (*a*) are preferably used for an engine as shown in FIG. 12.

FIG. 12 (*a*) is a cross-sectional view of an in-cylinder injection gasoline engine. The engine shown in FIG. 12 (*a*) is an exemplary two-intake-valve engine in which a fuel injector 100 is provided near the intake port, and an ignition plug is disposed at the center of the combustion chamber. The engine has a concept that stratified combustion is performed; fuel is injected during a compression process, a thick part and a thin part of the fuel spray are formed, and ignition is carried out. FIG. 12 (*b*) is a schematic view of the intake valve viewed from above the engine.

As described above, the fuel spray pattern of the fuel injector 100 is flat. The sprays 31 are inclined relative to the angle at which the fuel injector 100 is installed, so that the sprays travel toward the ignition plug 110. In ignition in the compression process, the energy of the sprays injected tends to be reduced because the pressure in the cylinder is high. However, the spray 31*a* of the sprays 31 in the present invention travels a sufficient distance toward the ignition plug 110. As a result, a fuel/air mixture, which is produced by mixing fuel drips or evaporated fuel and air, stays near the ignition plug 110 for a relative long period of time, thereby increasing the stability of combustion. The increased combustion stability provides a great degree of freedom in the setting of an ignition timing or injection timing. This improves the thermal efficiency of the engine and reduces fuel consumption. When this type of engine is mounted in an automobile, the high consumption stability enables stratified combustion to be performed over a wide range of engine loads and the number of revolutions, thereby reducing the fuel consumption.

Another advantage of the flat sprays is that collisions between the fuel and piston 103 are reduced and unburned fuel is suppressed from being exhausted. When fuel is injected in the compression process, the amount of fuel directed toward the piston 103 is preferably small because the distance between the fuel injector 100 and piston 103 is short and the piston approaches the fuel injector 100 with the time elapsed from the ignition. The travel distance is also preferably small.

As for ordinary in-cylinder injection gasoline engines, combustion stability is assured by colliding fuel to the piston to direct an air/fuel mixture to the ignition plug. When the fuel injector as shown in FIG. 5 is used, however, the collision of the fuel to the piston can be avoided and the combustion stability can be increased.

In FIG. 12, reference numeral 102 indicates a combustion chamber, 104 indicates a cavity formed on the piston, 105 indicates a cylinder, 106 indicates a cylinder head, 107 indicates an intake valve that opens and closes an intake port 108, 109 indicates an exhaust valve, and 110 indicates an ignition unit. Reference numeral 111 is an intake path that has a central partition for separating the intake port 108 and communicates upstream.

Embodiment 2

Figure 6A:
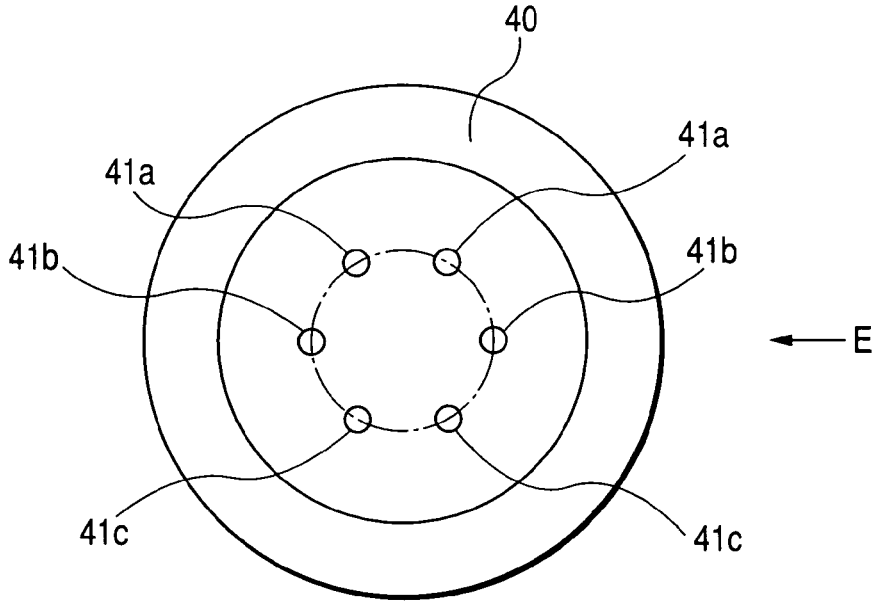
FIGS. 6(*a*) and 6(*b*) indicates the positions of the holes formed in the orifice plate of a fuel injector according to a second embodiment of the present invention.
Figure 6B:
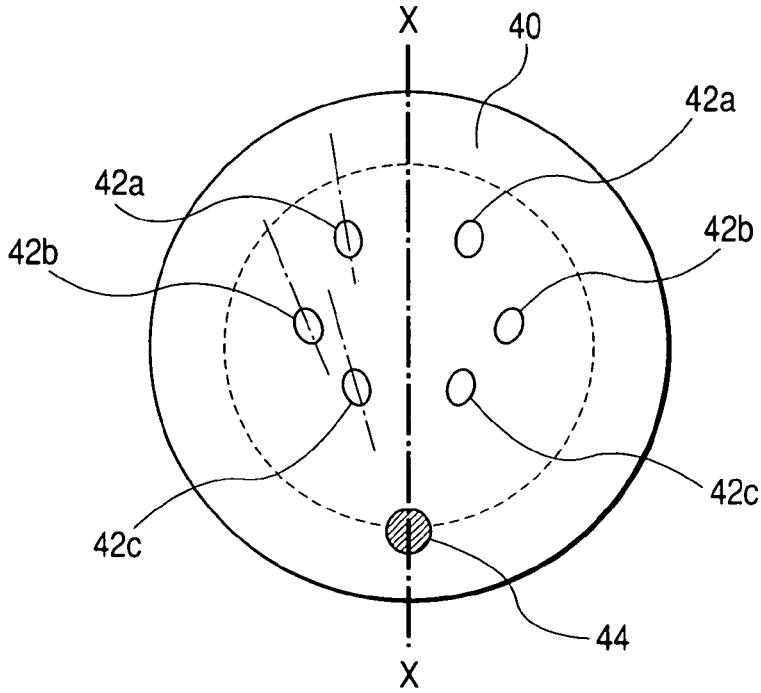
Figure 7A:
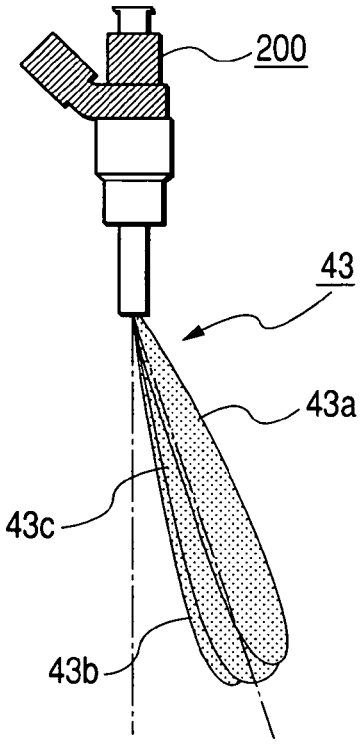
FIGS. 7(*a*)-7(*c*) schematically shows flat sprays obtained by the fuel injector, shown in FIG. 6, according to the second embodiment of the present invention.
Figure 7B:
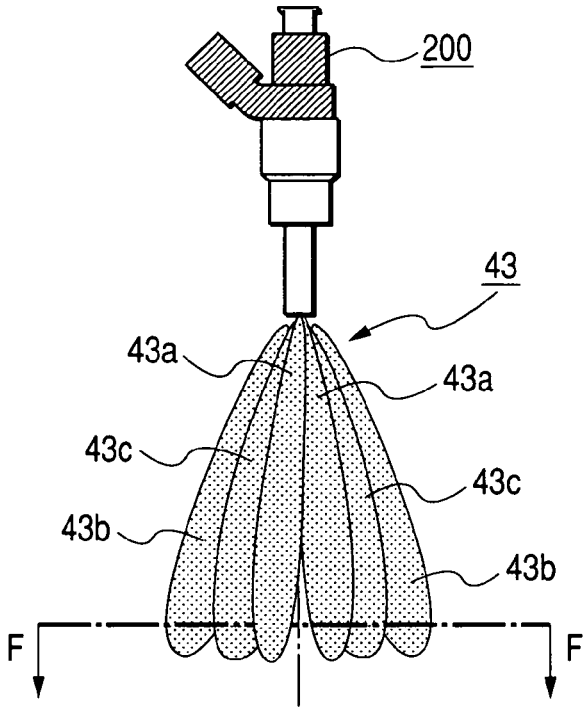
Figure 7C:
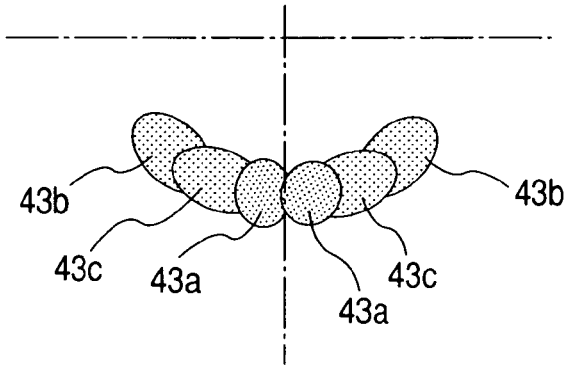

FIGS. 6 and 7 show the second embodiment of the present invention in which a substantially flat spray pattern is used as an example.

FIG. 6 shows the arrangement of nozzle holes 41 formed in an orifice plate 40. The other arrangement of the fuel injection is the same as the first embodiment.

FIG. 7 schematically shows sprays 43 that are obtained by the nozzle holes 41 formed in the orifice plate 40 shown in FIG. 6.

In FIG. 6, the nozzle holes 41*a*, 41*b*, and 41*c* are concentrically disposed and corresponding holes 42*a*, 42*b*, and 42*c* are formed at the outlet of the nozzle holes at angles directed to desired inclined-directions. This embodiment differs from embodiment 1 shown in FIG. 4 in that the holes 42*a* are inclined toward the outside so that they do not interfere with each other. Specifically, in FIG. 6 (*b*), the holes 42*a* are inclined by about 10 degrees relative to the X axis and by about 40 degrees in the plate thickness direction. Similarly, the holes 42*b* are inclined by about 30 degrees and by 30 degrees in the thickness direction, and the holes 42*c* are inclined by about 20 degrees and by 36 degrees in the thickness direction.

Reference numeral 44 in FIG. 6 (*b*) indicates a mark formed by, for example, marking or punching after the holes have been made. The mark clearly indicates the injection direction of fuel; the mark is useful when, for example, an engine is mounted.

Sprays 43 are nearly flat as shown in FIGS. 7 (*a*) to 7 (*c*). This is because the spreads of the sprays 43 injected from the nozzle holes are almost the same and energy conversion into the ambient atmosphere is also almost the same. Such a spray form causes the sprays to travel by the almost the same distance. The fuel injector is designed so that the sprays 43 do not cause mutual interference. Well-atomized sprays are thus obtained. It is advisable to provide these sprays in the space in the combustion chamber where they become flat in the compression process. Since the sprays are in a V-shaped form, adhesion of the fuel to the intake valve can be avoided, thereby increasing the stability of combustion.

Embodiment 3

Figure 8:
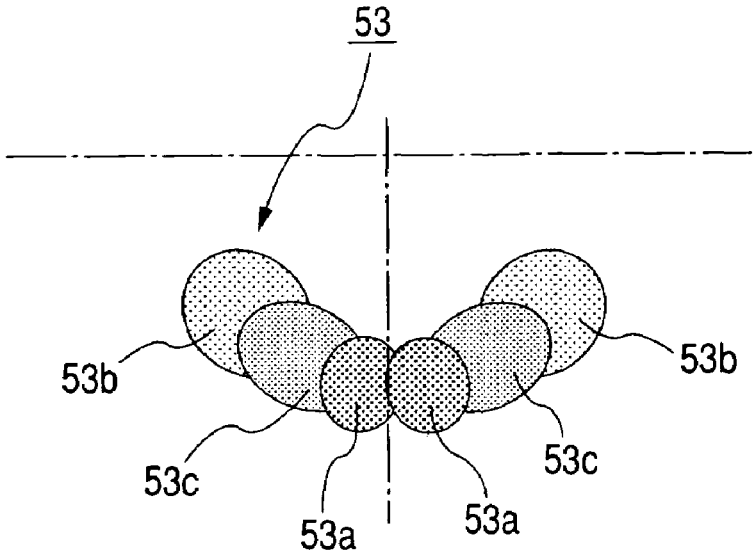
FIG. 8 schematically shows flat sprays obtained by a fuel injector according to the third embodiment of the present invention.

FIG. 8 shows the third embodiment of the present invention in which flat sprays having a concentration distribution are used as an example. FIG. 8 is a schematic cross-sectional view of sprays 53. The sprays 53 are formed by modifying the layout and inclination of the nozzle holes 29 of the previously mentioned embodiments.

In FIG. 8, the concentrations of the sprays 53*a*, 53*c*, and 53*b* are reduced gradually in that order. In order to form these sprays, the nozzle holes have the same diameters but have different shapes. As exemplary hole shapes, the holes 29*a* for the sprays 53*a* are strait holes, the hole 29*c* for the sprays 53*c* are extended holes with a desired spread area from the inlet toward the outlet thereof, and the hole 29*b* for the spray 53*b* are also extended holes with a further wider spread area from the inlet toward the outlet thereof. Therefore, the spreads of the sprays become large in succession. Atomization is also enhanced in succession, and thus the travel distances of the sprays become short in succession. These sprays can prevent fuel from adhering to the piston, so the stability of combustion can be further increased.

Embodiment 4

Figure 9:
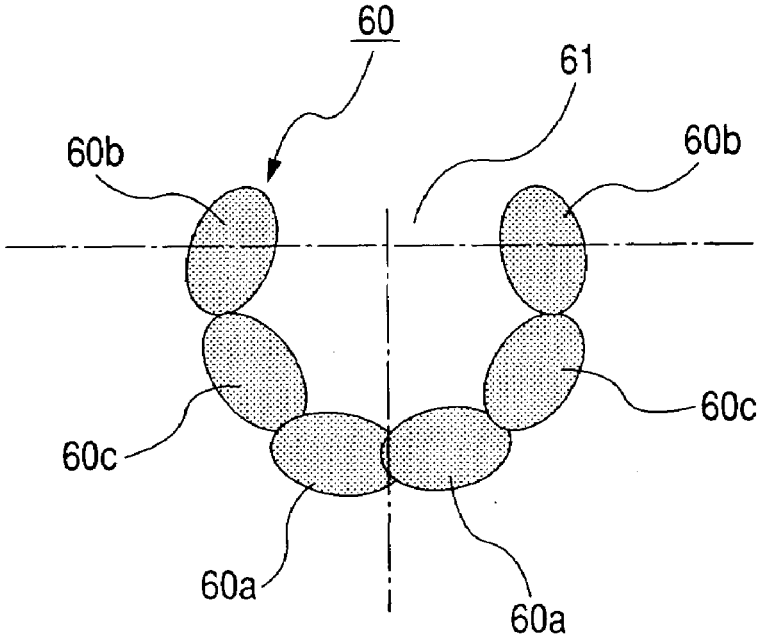
FIG. 9 schematically shows horseshoe sprays obtained by a fuel injector according to the fourth embodiment of the present invention.

FIG. 9 shows the fourth embodiment of the present invention in which sprays deflected in a horseshoe shape are used as an example. FIG. 9 is a schematic cross-sectional view of sprays 60. The sprays 60 in FIG. 9 are characterized in that an area 61 where there is almost no fuel distribution is provided. The sprays 60 are formed by modifying the layout and inclination of the nozzle holes 29 of the previously mentioned embodiments.

Figure 13A:
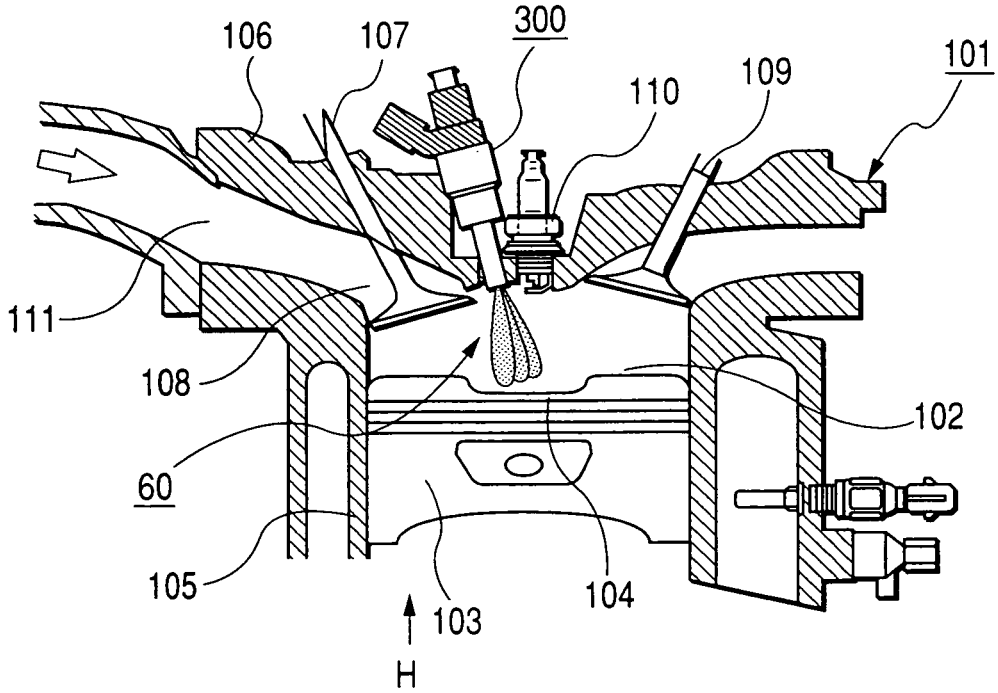
FIGS. 13(*a*) and 13(*b*) schematically shows an example in which the fuel injector, shown in FIG. 9, according to the fourth embodiment is mounted on an in-cylinder injection internal-combustion engine.
Figure 13B:
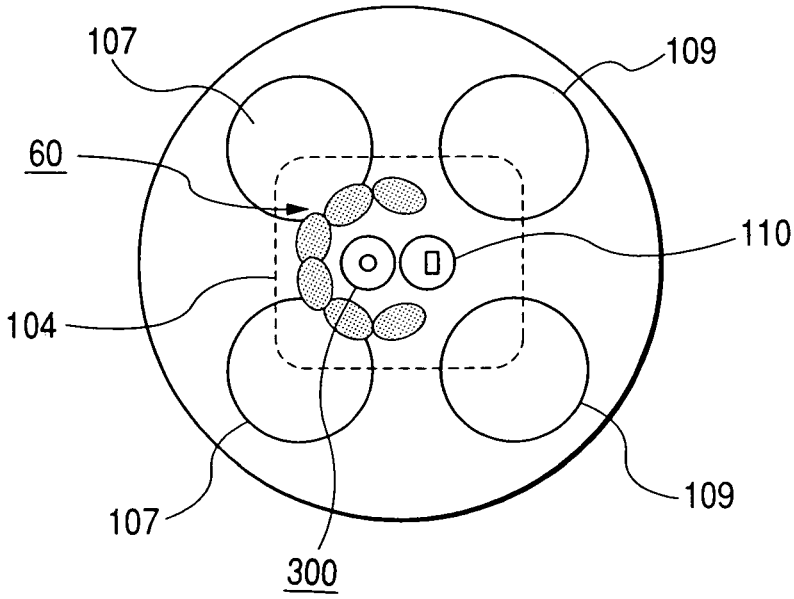

The sprays 60 in FIG. 9 are preferably used for an engine as shown in FIG. 13. FIG. 13 is a cross-sectional view of an exemplary in-cylinder injection gasoline engine in which a fuel injector 300 is disposed near the center of the combustion chamber. An engine having this disposition is mainly expected to consume less fuel by improving the stability of combustion and widening the range of operation conditions where stratified combustion is possible. Consequently, the homogeneity in the area of an air-fuel mixture corresponding to a combustible air-to-fuel ratio can be increased. Thereby, it is expected to reduce exhaustion of nitrogen oxides and other pollutants.

When the fuel injector 300 is disposed near the center of the combustion chamber as shown in FIG. 13, the distance between the ignition plug 110 and fuel injector 300 is short. It is preferable that the ignition plug 110 is disposed near the center of the combustion chamber so as to reduce the flame propagation time during ignition. If the distance between the ignition plug 110 and fuel injector 300 is too short, however, the fuel injected from the fuel injector 300 collides against the ignition plug 110 while the fuel is still liquid, which may contaminate the ignition plug 110. If the fuel is injected in a direction that is not toward the ignition plug 110 due to a change in the injection direction of fuel or another reason, it becomes hard to form an air-fuel mixture near the ignition plug and combustion cannot be stabilized easily.

The fuel injector 300 in this embodiment enables creation of an area 61 in which there is almost no fuel distribution. Therefore, an air-fuel mixture can be formed near the ignition plug 110 without the ignition plug 110 from being contaminated, increasing the stability of combustion.

The contamination of the ignition plug 110 occurs in an injection layout as shown in FIG. 13 (*b*). The stability of ignition and the stability of combustion are achieved by a cavity 104 formed on the piston 103. Specifically, when sprays are brought into the cavity 104, a combustible air-fuel mixture can be directed to the ignition plug 110.

According to the this embodiment, a fuel injector 300 that can form a suitable spray pattern can be provided even for an engine in which the fuel injector 300 is disposed near the center of the combustion chamber. As a result, the stability of combustion by the engine is increased, less fuel is consumed, and exhaustion is reduced.

Embodiment 5

Figure 10A:
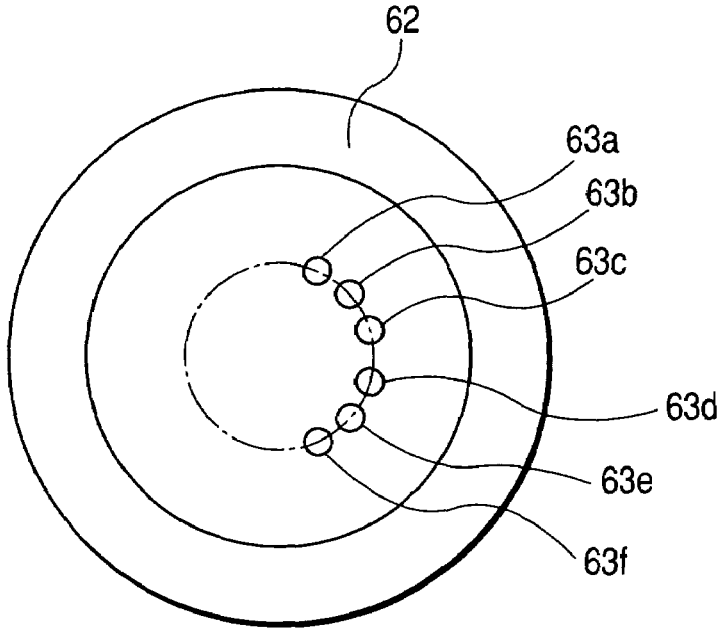
FIGS. 10(*a*) and 10(*b*) is a perspective view for indicating the positions of the holes formed in the orifice plate of a fuel injector according to the fifth embodiment of the present invention.
Figure 10B:
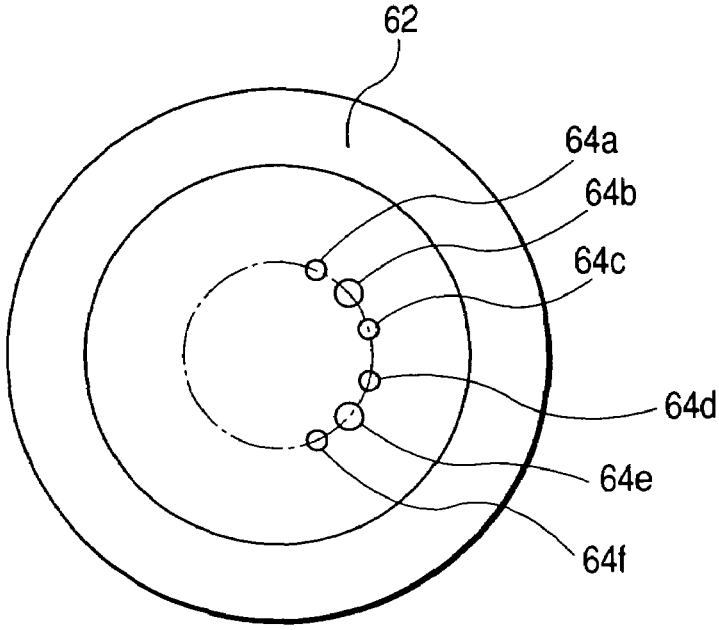

FIGS. 10 (*a*) and 10 (*b*) show a fifth embodiment of the present invention in which exemplary positions of nozzle holes 63 and 64 formed in the orifice plate. That is, reference numerals 63*a* to 63*f* are one example of the nozzle holes on in the orifice plate, reference numerals 64*a* to 64*f* are another example of the nozzle holes in the orifice plate. The sprays are formed by modifying the layout and inclination of the nozzle holes of the previously mentioned embodiments.

In FIGS. 10 (*a*) and 10 (*b*), the nozzle holes 63*a* to 63*f* and 64*a* to 64*f* are concentrically formed; the nozzle holes 63*a* to 63*f* are disposed in an uneven pitch, and the nozzle holes 64*a* to 64*f* are also disposed in an uneven pitch and have uneven diameters. An advantage of the nozzle holes 63*a* to 63*f* formed concentrically in an uneven pitch is that the amount of fuel injected from each hole can be equalized and the degree of freedom in the spray pattern can be increased. As for the nozzle holes 64*a* to 64*f* that are also formed concentrically in an uneven pitch and have uneven diameters, in addition to equalizing the amount of fuel injected from each hole and increasing the degree of freedom in the spray pattern, the amount of injection at each hole position can be changed.

What is claimed is:

1. An in-cylinder injection internal-combustion engine comprising a fuel injector for injecting fuel directly into a combustion chamber of a cylinder with an ignition plug, wherein the fuel injector is configured so that:

outlets of the plurality of nozzle holes of the fuel injector are disposed in the combustion chamber below an intake valve of the cylinder; substantially V-shaped flat sprays are injected from the fuel injector toward the ignition plug while being deflected from the fuel injector; an air-fuel mixture reaches the ignition plug by extending the travel distance of a central part of the fuel sprays from the nozzle holes; and the travel distances of the both sides of the sprays are shortened compared with the central part-fuel spray.

2. A fuel injector comprising: a plunger for opening/closing a fuel path to control the amount of fuel to be injected; a seat portion for the plunger; a plurality of nozzle holes for injecting fuel passed through between the plunger and the seat portion, and the fuel injector further comprising:

a nozzle plate provided with the seat portion, and a taper-fuel inlet hole whose diameter is gradually reduced from the seat toward its outlet; and a orifice plate arranged downstream from the taper-fuel inlet hole, and provided with a concave portion opposite to the nozzle plate, and a plurality of nozzle holes being formed concentrically at a bottom of the concave, wherein the plurality of nozzle holes are formed so that the outlet direction of each of the nozzle holes has a inclined angle within the outer surface of the orifice plate and in the direction of the plate thickness, with respect to the corresponding inlet of the plurality of nozzle holes formed at the concave bottom, and wherein each fuel injected from the plurality of nozzle holes has a deflected angle with respect to an injector axis and forms a spray pattern which is flat and is substantially V-shaped.

3. The fuel injector according to claim 2, wherein the substantially V-shaped and flat spray pattern is formed by using different shapes for the plurality of nozzle holes so that the concentration of the injected fuel is high near the center and is gradually lowered toward outer sides.

4. A fuel injector comprising: a plunger for opening/closing a fuel path to control the amount of fuel to be injected; a seat portion for the plunger; a plurality of nozzle holes for injecting fuel passed through between the plunger and the seat portion, and the fuel injector further comprising:

a nozzle plate provided with the seat portion, and a taper-fuel inlet hole whose diameter is gradually reduced from the seat toward its outlet; and a orifice plate arranged downstream from the taper-fuel inlet hole, and provided with a concave portion opposite to the nozzle plate, and a plurality of nozzle holes being formed concentrically at a bottom of the concave, wherein the plurality of nozzle holes are formed so that each nozzle hole has an inclined angle in the direction of the plate thickness within the concave area, and wherein the plurality of nozzle holes are a combination of straight holes and different tapered holes.

5. A fuel injector comprising: a plunger for opening/closing a fuel path to control the amount of fuel to be injected; a seat portion for the plunger: a plurality of nozzle holes for injecting fuel passed through between the plunger and the seat portion, and the fuel injector further comprising:

a nozzle plate provided with the seat portion, and a taper-fuel inlet hole whose diameter is gradually reduced from the seat toward its outlet; and a orifice plate arranged downstream from the taper-fuel inlet hole, and provided with a concave portion opposite to the nozzle plate, and a plurality of nozzle holes being formed concentrically at a bottom of the concave, wherein the plurality of nozzle holes are formed so that each nozzle hole has an inclined angle in the direction of the plate thickness within the concave area, and wherein with a plate thickness of a shoulder part of the concave in the orifice plate assumed to be t0 and a plate thickness of a thin part at the bottom thereof assumed to be t1, t0/t1 is 1.6 or more.

6. A fuel injector comprising: a plunger for opening/closing a fuel path to control the amount of fuel to be injected: a seat portion for the plunger; a plurality of nozzle holes for injecting fuel gassed through between the plunger and the seat portion, and the fuel injector further comprising:

a nozzle plate provided with the seat portion, and a taper-fuel inlet hole whose diameter is gradually reduced from the seat toward its outlet; and a orifice plate arranged downstream from the taper-fuel inlet hole, and provided with a concave portion opposite to the nozzle plate, and a plurality of nozzle holes being formed concentrically at a bottom of the concave, wherein the plurality of nozzle holes are formed so that each nozzle hole has an inclined angle in the direction of the plate thickness within the concave area, and wherein with a diameter of the fuel inlet hole assumed to be d1, a hole pitch of the plurality of nozzle holes formed concentrically assumed to be d2, and a plate thickness of the concave of the orifice plate assumed to be t, the following relations hold:

$$d2=2d1 \text{ and}$$

$$4t<d2<8t.$$

7. A fuel injector comprising: a plunger for opening/closing a fuel path to control the amount of fuel to be injected; a seat portion for the plunger; a plurality of nozzle holes for injecting fuel passed through between the plunger and the seat portion, and the fuel injector further comprising:

a nozzle plate provided with the seat portion, and a taper-fuel inlet hole whose diameter is gradually reduced from the seat toward its outlet; and a orifice plate arranged downstream from the taper-fuel inlet hole, and provided with a concave portion opposite to the nozzle plate, and a plurality of nozzle holes being formed concentrically at a bottom of the concave, wherein the plurality of nozzle holes are formed so that each nozzle hole has an inclined angle in the direction of the plate thickness within the concave area, and wherein the fuel inlet hole is configured by a taper upstream portion a middle portion, and an extended downstream portion, wherein the diameter of the taper upstream portion is gradually reduced from the seat up to the middle portion, and the diameter of the extended downstream portion is extended in a shallow conical-shape from the middle portion toward downstream.

8. A fuel injector according to claim 1, wherein the plurality of nozzle holes are a combination of straight holes and different tapered holes.

9. A fuel injector comprising: a plunger for opening/closing a fuel path to control the amount of fuel to be injected; a seat portion for the plunger: a plurality of nozzle holes for injecting fuel passed through between the plunger and the seat portion, and the fuel injector further comprising:

a nozzle elate provided with the seat portion, and a taper-fuel inlet hole whose diameter is gradually reduced from the seat toward its outlet; and a orifice plate arranged downstream from the taper-fuel inlet hole, and provided with a concave portion opposite to the nozzle plate, and a plurality of nozzle holes being formed concentrically at a bottom of the concave, wherein the plurality of nozzle holes are formed so that the outlet direction of each of the nozzle holes has a inclined angle within the outer surface of the orifice plate and in the direction of the plate thickness, with respect to the corresponding inlet of the plurality of nozzle holes formed at the concave bottom, and wherein the plurality of nozzle holes are a combination of straight holes and different tapered holes.

10. A fuel injector comprising: a plunger for opening/closing a fuel path to control the amount of fuel to be injected; a seat portion for the plunger; a plurality of nozzle holes for injecting fuel passed through between the plunger and the seat portion, and the fuel injector further comprising:

a nozzle plate provided with the seat portion, and a taper-fuel inlet hole whose diameter is gradually reduced from the seat toward its outlet; and a orifice plate arranged downstream from the taper-fuel inlet hole, and provided with a concave portion opposite to the nozzle plate, and a plurality of nozzle holes being formed concentrically at a bottom of the concave, wherein the plurality of nozzle holes are formed so that the outlet direction of each of the nozzle holes has a inclined angle within the outer surface of the orifice plate and in the direction of the plate thickness, with respect to the corresponding inlet of the plurality of nozzle holes formed at the concave bottom, wherein the fuel inlet hole is configured by a taper upstream portion; a middle portion, and an extended downstream portion, and wherein the diameter of the taper upstream portion is gradually reduced from the seat up to the middle portion, and the diameter of the extended downstream portion is extended in a shallow conical-shape from the middle portion toward downstream.

11. A fuel injector comprising: a plunger for opening/closing a fuel oath to control the amount of fuel to be injected; a seat portion for the plunger; a plurality of nozzle holes for injecting fuel passed through between the plunger and the seat portion, and the fuel injector further comprising:

a nozzle plate provided with the seat portion, and a taper-fuel inlet hole whose diameter is gradually reduced from the seat toward its outlet; and a orifice plate arranged downstream from the taper-fuel inlet hole, and provided with a concave portion opposite to the nozzle plate, and a plurality of nozzle holes being formed concentrically at a bottom of the concave, wherein the plurality of nozzle holes are formed so that the outlet direction of each of the nozzle holes has an inclined angle within the outer surface of the orifice plate and in the direction of the plate thickness, with respect to the corresponding inlet of the plurality of nozzle holes formed at the concave bottom, and that the inclined directions of at least one pair of nozzle holes are parallel inside the concave bottom, and wherein the plurality of nozzle holes are a combination of straight holes and different tapered holes.

12. A fuel injector comprising: a plunger for opening/closing a fuel path to control the amount of fuel to be injected; a seat portion for the plunger; a plurality of nozzle holes for injecting fuel passed through between the plunger and the seat portion, and the fuel injector further comprising:

a nozzle plate provided with the seat portion, and a taper-fuel inlet hole whose diameter is gradually reduced from the seat toward its outlet; and a orifice plate arranged downstream from the taper-fuel inlet hole, and provided with a concave portion opposite to the nozzle plate, and a plurality of nozzle holes being formed concentrically at a bottom of the concave, wherein the plurality of nozzle holes are formed so that the outlet direction of each of the nozzle holes has an inclined angle within the outer surface of the orifice plate and in the direction of the plate thickness, with respect to the corresponding inlet of the plurality of nozzle holes formed at the concave bottom, and that the inclined directions of at least one pair of nozzle holes are parallel inside the concave bottom, wherein the fuel inlet hole is configured by a taper upstream portion, a middle portion, and an extended downstream portion, and wherein the diameter of the taper upstream portion is gradually reduced from the seat up to the middle portion, and the diameter of the extended downstream portion is extended in a shallow conical-shape from the middle portion toward downstream.

* * * * *